US006507967B2

(12) United States Patent
Johnson

(10) Patent No.: US 6,507,967 B2
(45) Date of Patent: Jan. 21, 2003

(54) LAUNDRY APPLIANCE WITH VERSATILE PROGRAMMING CONTROL DEVICE

(75) Inventor: Troy A. Johnson, Newton, IA (US)

(73) Assignee: Maytag Corporation, Newton, IA (US)

( * ) Notice: Subject to any disclaimer, the term of this patent is extended or adjusted under 35 U.S.C. 154(b) by 147 days.

(21) Appl. No.: 09/809,172

(22) Filed: Mar. 16, 2001

(65) Prior Publication Data

US 2002/0138918 A1 Oct. 3, 2002

(51) Int. Cl.[7] ..... D06F 39/00

(52) U.S. Cl. ..... 8/159; 68/12.23; 68/12.27; 200/11 R; 200/11 J

(58) Field of Search ..... 68/12.23, 12.27; 8/159; 200/11 R, 11 J, 11 K, 35 H, 564, 336

(56) References Cited

U.S. PATENT DOCUMENTS

| | | | | |
|---|---|---|---|---|
| 3,148,321 A | * | 9/1964 | Holzer | 68/12.23 X |
| 3,171,987 A | * | 3/1965 | Holzer | 68/12.23 X |
| 3,372,597 A | | 3/1968 | Dotto | |
| 4,225,758 A | | 9/1980 | Kondo et al. | |
| 4,320,267 A | | 3/1982 | Greve et al. | |
| 4,523,062 A | | 6/1985 | Mahon | |
| 4,827,460 A | | 5/1989 | Mahon et al. | |
| 5,895,600 A | | 4/1999 | Lee | |
| 5,959,267 A | | 9/1999 | Kawasaki et al. | |
| 5,967,304 A | | 10/1999 | Mackay et al. | |

FOREIGN PATENT DOCUMENTS

| | | | | |
|---|---|---|---|---|
| GB | 2168536 | * | 6/1986 | 68/12.27 |

* cited by examiner

*Primary Examiner*—Philip Coe
(74) *Attorney, Agent, or Firm*—Diederiks & Whitelaw, PLC

(57) ABSTRACT

A control device for a laundry appliance includes a member which need only be manually shifted through a limited range of travel, from a neutral position to which the control member is biased, in either of first and second opposing directions, to establish a desired cycle and to adjust an operational time for the cycle. The control member is provided with numerous movable contacts which are interposed between fixed contacts. Shifting of the control member a limited amount in either direction will function to engage a single pair of the contacts, while shifting the control member a further amount in the same direction causes another pair of the contacts to become engaged. In this manner, the contacts are paired to slowly increase or decrease the operational time and to also select either the next or previous operational cycle. User feedback of the selected setting is preferably provided through the use of a illuminated indicator that shifts around a track adjacent operational indicia.

24 Claims, 2 Drawing Sheets

LAUNDRY APPLIANCE WITH VERSATILE PROGRAMMING CONTROL DEVICE

BACKGROUND OF THE INVENTION

1. Field of the Invention

The present invention pertains to the art of laundry appliances and, more specifically, to the incorporation of a versatile programming control arrangement in a laundry appliance.

2. Discussion of the Prior Art

In a laundry appliance, such as a clothes washer or dryer, it is necessary for a consumer to establish a certain operating cycle, as well as a desired operating time for the cycle. For example, in a washing machine, either before or after loading a tub of the machine with clothes to be laundered, the user must establish both a desired cycle and to establish an operating time for the cycle. Typically, a rotatable control knob is provided on a control panel of the appliance, with the knob having associated graphic zones thereabout to signify different, selectable cycles. For instance, a conventional washing machine would incorporate a knob which can rotate through 360° for use in selecting between the washing of whites, delicates or colors. The knob would have associated therewith an indicator which generally functions as a pointer to provide feedback to the user of the selected operation.

The time needed to perform the selected operation depends on the positioning of the knob within a given cycle range. For example, the consumer can set the appliance to perform a light, normal or heavy washing operation, with each of these settings functioning to establish the length of time needed to perform the selected washing cycle. Additionally, the consumer could simply select a rinse mode, along with the time for the rinse mode.

In such a commonly known cycle and time setting arrangement utilizing a rotatable control knob, the knob can only be rotated in one direction. As the cycles for whites, delicates and colors are sequentially arranged about the knob, the knob often has to be rotated through a significant angular range to reach a desired position. In addition, since the knob can only be rotated in one direction, if the user even slightly over-rotates the knob, the user must then rotate the knob through slightly less than 360° to finally reach the desired setting. Obviously, this overall control setting arrangement is quite inefficient.

A similar rotatable control knob arrangement for use in selecting both cycle and operating times can also be found in many clothes dryers. That is, it is known to provide a rotatable knob on a clothes dryer wherein the knob is used to select both the drying cycle, generally based on the type of clothing articles to be dried, and the drying time. Therefore, the same type of disadvantages discussed above with respect to the known washing machine control arrangements can also pertain to clothes dryers. In any event, there exists a need in the art of laundry appliances for an improved operation cycle and time setting control device wherein operation cycles and times can be easily and efficiently established.

SUMMARY OF THE INVENTION

The present invention pertains to a control device including a member which need only be manually shifted through a limited range of travel to establish a desired cycle and to adjust an operational time for the cycle in a laundry appliance. In accordance with a preferred embodiment of the invention, the control member has associated therewith four movable contacts which are arranged in pairs and interposed between three fixed contacts. Shifting of the control member a small amount in a first direction will function to engage a single pair of the contacts which, in accordance with a preferred embodiment of the invention, will cause a slow increase in the cycle time for the appliance. A larger shift of the control member causes another one of the movable contacts to engage another fixed contact to cause a change in the operation cycle for the appliance, preferably towards a previous cycle.

The control member is preferably biased to a center or neutral position. In a corresponding manner, a small shift of the control member from the neutral position in a second direction, opposite the first direction, causes a slow decrease in the cycle time. A larger shift of the control member in the second direction causes the system to advance to the next cycle. In any event, with this system, contacts which move with the control member can cooperate with fixed contacts to enable both time and cycle adjustments by the user through only a very limited range of travel of the control member.

In accordance with the most preferred form of the invention, the control member constitutes a rotary knob which need only be rotated a few degrees in order to complete a programming operation in a quick and convenient manner. In one embodiment of the invention, the control knob can only be rotated through approximately 15° either direction from the neutral position. Around the rotary control knob is provided an annular graphic zone and an indicator is utilized to reflect the programmed information to the user. Most preferably, a light is provided in the annular zone to indicate both the cycle selected by the user and also the established cycle time. Therefore, the appliance control provides immediate feedback, in a consumer friendly manner, by lighting up a specified portion of an illumination track. When a rotary control member is utilized, the illumination track generally simulates a dial skirt.

Additional objects, features and advantages of the present invention will become more fully apparent from the following detailed description of a preferred embodiment, when taken in conjunction with the drawings wherein like reference numeral refer to corresponding parts in the several views.

DETAILED DESCRIPTION OF THE PREFERRED EMBODIMENT

Figure 1:
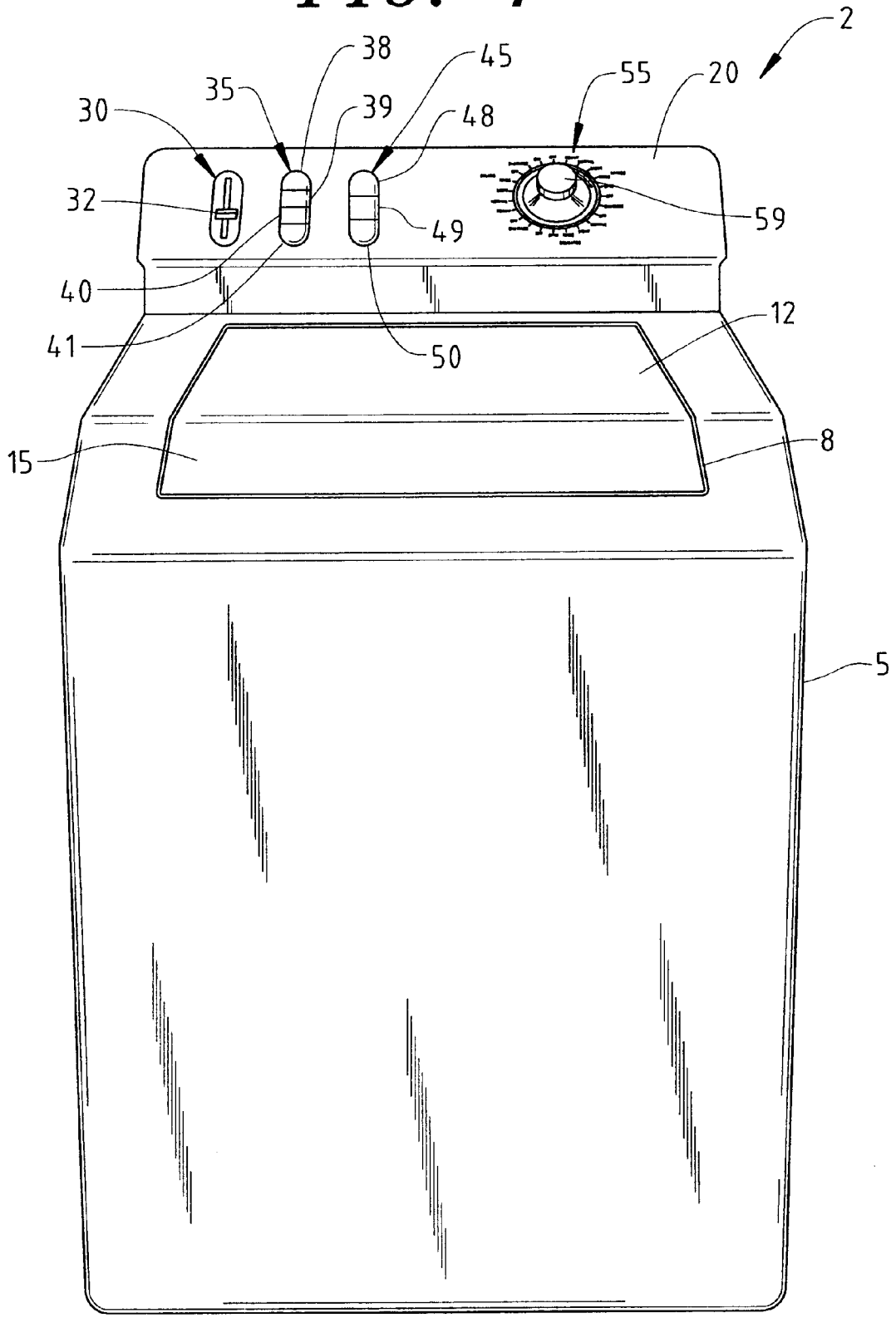
FIG. 1 is a front perspective view of a top loading washing machine incorporating the programming control device of the present invention.

With initial reference to FIG. 1, a laundry appliance constructed in accordance with the present invention is generally indicated at 2. For exemplary purposes, laundry appliance 2 is shown to be constituted by a clothes washer. However, as will become more fully evident below, the invention is also applicable to clothes dryers as well. As shown, laundry appliance 2 includes an outer cabinet 5 provided with an upper opening 8 that can be selectively closed by means of a pivotable lid 12. In a manner widely known in the art, lid 12 can be raised to provide access to a rotatable basket (not shown) mounted within cabinet 5, with clothes to be laundered being adapted to be placed in the basket. In the preferred embodiment shown, lid 12 includes an angled front portion 15 to enhance access to within cabinet 5.

At a rear portion of cabinet 5 is arranged a control panel 20 that includes various control units which can be used to program a desired laundering operation for appliance 2. In the preferred embodiment shown, control panel 2 includes a first control unit 30 having a vertically shiftable knob 32. Knob 32 is adapted to be shifted between raised and lowered positions in order to enable a user of appliance 2 to select a desired load size. For instance, knob 32 can be shifted between mini, medium, large and super load capacity positions, as well as potential reset position. Control panel 20 also includes a second control unit 35 that is defined by a plurality of buttons 38–41. Second control unit 35 is provided in accordance with the exemplary embodiment of the invention of a washer machine in connection with establishing wash and rinse temperatures. Therefore, button 38 is used to establish hot/cold wash/rinse temperatures; button 39 is used to establish warm/warm wash/rinse temperatures; button 40 is used to establish warm/cold wash/rinse temperatures; and button 41 is used to establish cold/cold wash/rinse temperatures respectively.

Adjacent second control unit 35 is a third control unit 45 which is defined, in the preferred embodiment shown, by buttons 48–50. Third control unit 45 can be used by a consumer to selectively establish a super wash operation through the use of button 48, the application of a second rinse through button 49, and to cancel either of these control features through button 50.

In addition to these operating parameters, it is also necessary to establish both a desired cycle and operational time for a laundry operation to be performed within appliance 2. To this point, it should be recognized that first, second and third control units 30, 35 and 45 are dedicated for use in connection with the preferred embodiment of laundry appliance 2 being a washing machine. Obviously, the need for this number of control units and/or the functions performed thereby would change when utilizing the invention in connection with a clothes dryer. In general, the structure described above with respect to laundry appliance 2 is already known in the art and does not constitute part of the present invention. Therefore, this structure has only been described for the sake of completeness. Instead, the present invention is particularly directed to the structure and function of a fourth control unit 55 formed as part of control panel 20.

Figure 2:
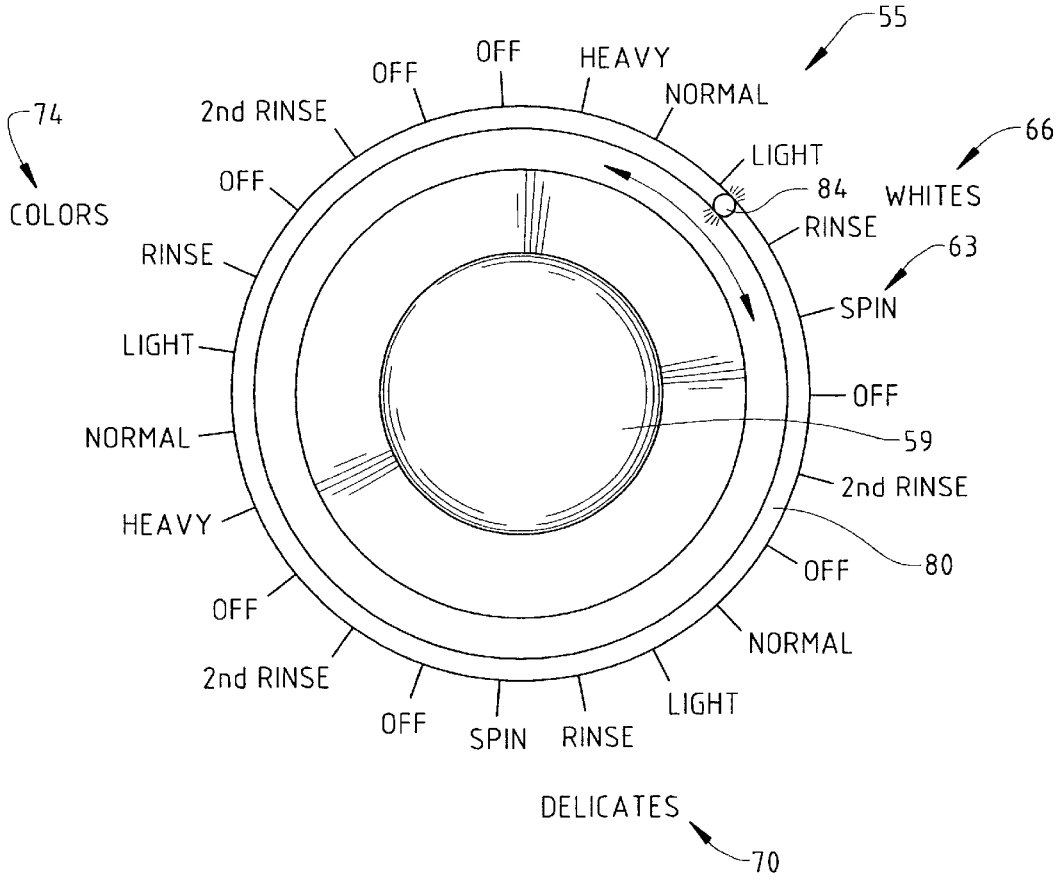
FIG. 2 is enlarged, front view of a control dial incorporated in the programming control device of FIG. 1.

As shown in both FIGS. 1 and 2, fourth control unit 55 includes a control member 59 that preferably takes the form of a rotatable knob. About control member 59 is provided graphic indicia generally indicated at 63 which, in the preferred embodiment shown, is essentially divided into first, second and third graphic zones 66, 70 and 74 respectively. First graphic zone 66 is used in connection with the preferred embodiment of the invention to represent a washing cycle for whites; second graphic zone 70 represents a washing zone for delicate clothing articles; and third graphic zone 74 represents a washing cycle selection zone for colored garments. As will be readily evident to the reader of this disclosure, the provision of indicia defined within zones around a rotatable knob within a washing machine is also quite prevalent in the art. However, it is particularly the manner in which control member 59 is shifted to establish a particular operation cycle as represented by the various zones, along with the operational time for the selected cycle, that is of particular concern as will be more detailed more fully below.

Disposed annularly about control member 59 and radially positioned between control member 59 and graphic indicia 63 is an annular illumination track 80 as clearly shown in FIG. 2. Disposed within annular illumination track 80 is an indicator 84 which is preferably constituted by a light element such as an LED or diode. Indicator 4 is used to convey to the user of appliance 2 an established desired cycle and operational time for a laundry operation. For example, in the position shown in FIG. 2, indicator 84 represents a selected cycle for whites, with the operation being established for a relatively short cycle due to light clothes soiling.

Figure 3:
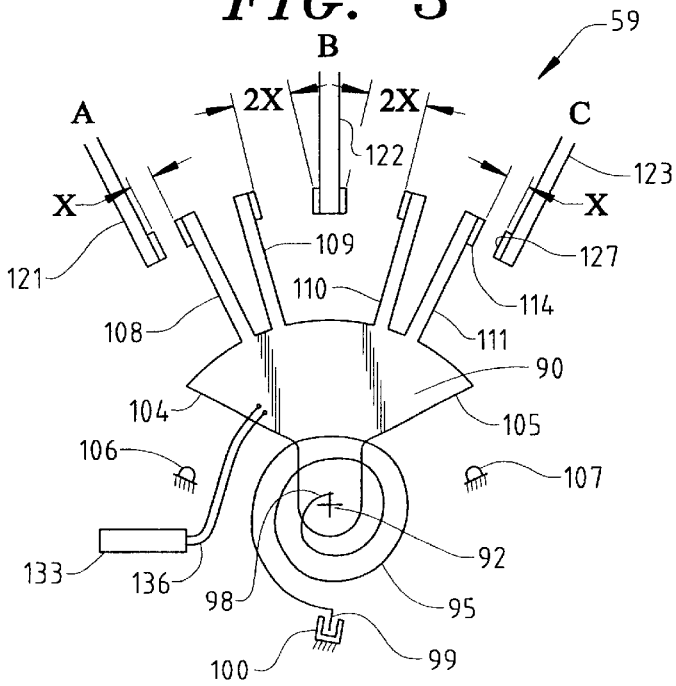
FIG. 3 depicts an electrical contact and rotary control arrangement according to a preferred embodiment of the invention.

FIG. 3 illustrates details of control member 59. More specifically, control member 59 includes an inner body portion 90 that is rotatable about an axis 92. As will be detailed fully below, body portion 90 is only rotatable about a limited angular range in opposing directions. That is, body portion 90 is biased to a neutral position as shown in FIG. 3 and can be rotated either clockwise or counterclockwise. In the most preferred embodiment, body portion 90 is biased by means of a torsion spring 95 including a first end 98 attached to body portion 90 adjacent axis 92 and a second end 99 that is fixed at 100. As shown, body portion 90 includes angled side portions 104 and 105 which are adapted to cooperate with stop abutments 106 and 107 respectively for limiting the rotational angle or shifting of control member 59. In a preferred embodiment of the invention, this angular movement is limited to a range of no more than 45°. In the most preferred embodiment, body portion can only be shifted from the neutral position through approximately 15° in either the clockwise or counterclockwise rotational directions.

Extending from body portion 90 are a plurality of spaced contact members 108–111. Most preferably, each contact member 108–111 has arranged on a tip thereof an electrical contact, such as that indicated at 114. Control member 59 also has associated therewith a plurality of fixed contact elements 121–123. In a manner similar to contact members 108–111, fixed contact elements 121–123 also have associated electrical contacts on tips thereof, such as indicated at 127. As will be detailed further below, contact members 108–111 are adapted to be electrically interconnected with respective ones of fixed contact elements 121–123 through the engagement of electrical contacts 114 and 127 in order to complete an electrical circuit through body portion 90 in order to direct signals to a program module 133 of control panel 20 through various wires 136.

In the most preferred embodiment depicted in FIG. 3, contact members 108 and 109 are interposed between contact elements 121 and 122, while contact members 110 and 111 are interposed between contact elements 122 and 123. More specifically, while body portion 90 and, commensurately, overall control member 59, is in a neutral position, contact member 108 is preferably spaced a distance X from contact element 121. Contact member 111 is similarly distanced from contact element 123. On the other hand, contact members 109 and 110 are spaced a greater distance than distance X from contact element 122. In the most preferred form of the invention, contact members 109 and 110 are each spaced a distance equivalent to 2X from contact element 122.

With this arrangement, rotation of control member 59 in a first direction, such as a counterclockwise direction, will always initially cause contact member 108 to engage contact element 121. That is, after body portion 90 has been shifted through an arcuate distance equal to X, the electrical contact 114 of contact member 108 will engage the electrical contact 127 of contact element 121 in order to send a signal through a respective wire 136 to program module 133. Continued rotation of control member 59 in the counterclockwise direction will cause contact member 110 to engage contact element 122. Of course, this engagement requires some flexing of either or both of contact member 108 and contact element 121. In the most preferred form of the invention, each of contact members 108–111 and contact elements 121–123 can be elastically deflected. As indicated above, the distance X only represents a minimal angular shifting of body portion 90, most preferably through approximately 15°.

In a similar fashion, control member 59 can be rotated in the clockwise direction from the neutral position shown in FIG. 3 in order to initially engage contact member 111 with contact element 123 and, upon further rotation in the clockwise direction, to cause contact member 109 to engage contact element 122. Again, each of these interengagements function to complete an electrical circuit whereby control signals are forwarded through wires 136 to program module 133 for appliance 2.

In the most preferred form of the invention, the engagement of contact member 108 with contact element 121 functions to slowly increase the cycle time for a laundry operation. Therefore, with the engagement of contact member 108 and contact element 121, indicator 84 shown in FIG. 2 would slowly shift toward the "light" setting and, if maintained in engagement, further toward the "normal" and "heavy" settings. Further rotation of control member 59 will also cause the abutment of contact member 110 and contact element 122. In accordance with the most preferred embodiment, this functions to shift the overall selected cycle for appliance 2 to a previous cycle. Therefore, if this momentary switch contact was made, indicator 84 would jump from the WHITES cycle setting to the COLORS cycle setting.

On the other hand, rotation of body portion 90 in the clockwise direction will cause contact 111 to engage contact element 123 to slowly decrease the cycle time established for the particular laundry operation. Further rotation in the clockwise direction also causes engagement between contact member 109 and contact element 122 which functions to shift the overall selected cycle to the next cycle, i.e., in a clockwise direction about the illustrated graphic indicia 63.

With this arrangement, only limited rotational movement of control member 59 is required to easily establish and adjust desired cycle and operational times for a particular laundry operation to be performed within appliance 2. If the desired setting position as represented to the user through indicator 84 is passed, it would not be necessary to rotate main selector knob through nearly 360° as with conventional, rotatable control knob arrangements. Instead, only a limited degree of rotation of control member 59 in a predetermined direction is required.

Although described with respect to a preferred embodiment of the invention, it should be readily understood that various changes and/or modifications can be made to the invention without departing from the spirit thereof. For instance, although the engagement between the various contact members 108–111 and contact elements 121–123 have been disclosed with respect to performing particular setting functions, it should be readily understood that the arrangement of the functions could be readily altered. In addition, such a setting control arrangement could be employed for use in connection with other parameters needing to be set for appliance 2. Furthermore, control member 59 could also be linearly shifted, instead of rotated in opposing directions from a neutral position to perform corresponding functions. Therefore, it is only important that limited shifting is required which enhances the ability for appliance 2 to be efficiently programmed in a quick and convenient manner. The use of indicator 84 and annular illumination track or zone 80 provides immediate feedback, in a consumer friendly manner, to the user. When control member 59 is rotary in accordance with the preferred embodiment, graphic indicia 63 generally simulates a conventional dial skirt which will be readily recognized by the user. In any event, the invention is only intended to be limited by the scope of the following claims.

I claim:

1. In a clothes laundering appliance having a plurality of user selectable settings for cycle and operational times, a control device for use in setting both the cycle and operational times for a laundry operation comprising:

a control member which is manually shiftable from a neutral position through a predetermined range of travel in first and second, opposing directions;

a plurality of spaced contact members movable with said control member; and a plurality of spaced contact elements, wherein the control member may be selectively shifted varying amounts in each of the first and second, opposing directions to interengage respective ones of the plurality of contact members and contact elements in order to selectively establish the desired cycle and operational time for the laundry operation.

2. The control device according to claim 1, wherein the control member is rotatable.

3. The control device according to claim 2, wherein the control member is rotatable only through less than 45°.

4. The control device according to claim 3, wherein the control member is rotatable only through approximately 15° from the neutral position in each of the first and second opposing directions.

5. The control device according to claim 1, wherein the appliance is adapted to operate in at least two different cycles, with each cycle having a wide range of selectable operational times and wherein the control device further comprises: indicia provided about at least a portion of the control member, said indicia representing the at least two cycles and the varying operational times.

6. The control device according to claim 5, further comprising: an indicator movable along the indicia based on the setting of the desired cycle and operational time.

7. The control device according to claim 6, wherein said indicia extends annularly about the control member.

8. The control device according to claim 1, further comprising: a spring member for biasing the control member to the neutral position.

9. The control device according to claim 8, wherein said plurality of spaced contact members and spaced contact elements include at least two movable contacts and three fixed contacts, each of said two movable contacts being interposed between respective ones of said three fixed contacts.

10. The control device according to claim 9, wherein four contact members are interposed between three contact elements.

11. The control device according to claim 10, wherein shifting of said control member a first predetermined amount in the first direction causes a first pair of the plurality of spaced contact members and contact elements to become engaged, shifting of the control member a second predetermined amount, which is greater than the first predetermined amount, in the first direction causes a second pair of the plurality of spaced contact members and contact elements to become engaged, shifting of the control member a third predetermined amount in the second direction causes a third pair of the plurality of spaced contact members and contact elements to become engaged, and shifting of the control member a fourth predetermined amount in the second direction causes a fourth pair of the plurality of spaced contact members and contact elements to become engaged, with engagement of each pair of the spaced contact members and contact elements functioning to alter at least one of a cycle and operational time parameter of the appliance in order to establish the desired cycle and operational time for the laundry operation.

12. An appliance for laundering clothes comprising:

a cabinet including an access opening;

a lid, pivotally attached to the cabinet, for enabling clothes to be placed into and removed from the appliance through the access opening; and means, including a control member manually shiftable through a predetermined range of travel in first and second, opposing directions from a neutral position, for setting both cycle and operational times for the appliance.

13. The appliance according to claim 12, wherein said setting means comprises a manually rotatable control member.

14. The appliance according to claim 13, wherein the control member is rotatable only through less than 45°.

15. The appliance according to claim 14, wherein the control member is rotatable only through approximately 15° from the neutral position in each of the first and second opposing directions.

16. The appliance according to claim 15, further comprising: a spring member for biasing the setting means to the neutral position.

17. The appliance according to claim 12, wherein the appliance is adapted to operate in at least two different cycles, with each cycle having a wide range of selectable operational times and wherein the appliance further comprises: indicia provided about at least a portion of the setting means, said indicia representing the at least two cycles and the varying operational times.

18. The appliance according to claim 17, further comprising: an indicator movable along the indicia based on the setting of the desired cycle and operational time.

19. The appliance according to claim 18, wherein said indicia extends annularly about the setting means.

20. The appliance according to claim 12, wherein said setting means comprises a shiftable control member, a plurality of spaced contact members movable with said control member, and a plurality of spaced contact elements, and wherein shifting of said control member a first predetermined amount in the first direction causes a first pair of the plurality of spaced contact members and contact elements to become engaged, shifting of the control member a second predetermined amount, which is greater than the first predetermined amount, in the first direction causes a second pair of the plurality of spaced contact members and contact elements to become engaged, shifting of the control member a third predetermined amount in the second direction causes a third pair of the plurality of spaced contact members and contact elements to become engaged, and shifting of the control member a fourth predetermined amount in the second direction causes a fourth pair of the plurality of spaced contact members and contact elements to become engaged, with engagement of each pair of the spaced contact members and contact elements functioning to alter at least one of a cycle and operational time parameter of the appliance in order to establish the desired cycle and operational time for the laundry operation.

21. A method of setting both a desired cycle and operational time for a laundry operation in an appliance comprising:

rotating a control member from a neutral position in a first direction a first amount to cause a first set of electrical contacts to become engaged in order to adjust one of the cycle and the operational time; and continuing to rotate the control member in the first direction a second amount to cause a second set of electrical contacts to further become engaged in order to adjust another of the cycle and the operational time wherein, from the neutral position through the second amount, the control member being permitted to rotate through a maximum angle of 45°.

22. The method according to claim 21, further comprising:

limiting a permissible angular rotation of the control member to approximately 15° in each of opposing first and second directions from the neutral position.

23. The method according to claim 21, further comprising:

providing a visual indication to a user of said cycle and operational times.

24. The method according to claim 21, further comprising:

biasing the control member to the neutral position.

* * * * *